United States Patent [19]

Ogasawara et al.

[11] 4,374,796

[45] Feb. 22, 1983

[54] METHOD FOR LOADING COSMETIC MATERIAL INTO HOLLOW SPACE

[75] Inventors: Hirotake Ogasawara, Funabashi; Yoshiharu Hatakeyama; Mitsuo Ishiguro, both of Tokyo, all of Japan

[73] Assignees: Shiseido Company, Ltd.; Yoshida Industry Co., Ltd., both of Tokyo, Japan

[21] Appl. No.: 204,255

[22] Filed: Nov. 5, 1980

[30] Foreign Application Priority Data

| | | | |
|---|---|---|---|
| Feb. 18, 1980 | [JP] | Japan | 55-17935 |
| Feb. 22, 1980 | [JP] | Japan | 55-20560 |
| Jul. 10, 1980 | [JP] | Japan | 55-93276 |

[51] Int. Cl.[3] ..... B29J 5/00

[52] U.S. Cl. ..... 264/101; 264/109; 264/267; 264/268

[58] Field of Search ..... 264/39, 101, 109, 267, 264/268

[56] References Cited

U.S. PATENT DOCUMENTS 2,573,141 10/1951 Heinrich ..... 264/109

*Primary Examiner*—James R. Hall

*Attorney, Agent, or Firm*—Wenderoth, Lind & Ponack

[57] ABSTRACT

Cosmetic material prepared by mixing powder cosmetic material with a binder and solvent is injected under a predetermined pressure into a hollow closed space partially defined by a porous absorbing material, whereby the solvent in the cosmetic material is absorbed into the absorbing material and the powder cosmetic material is solidified in the hollow closed space.

11 Claims, 15 Drawing Figures

METHOD FOR LOADING COSMETIC MATERIAL INTO HOLLOW SPACE

BACKGROUND OF THE INVENTION

This invention relates to a method for loading a cosmetic material into a hollow space such as a space in a shallow cup.

In one conventional method for loading a cosmetic material into a vanity case, a powder cosmetic material mixed with a binder is supplied into a metal cup in an overflowing heap and then a pressure is applied from the top thereof to solidify the cosmetic material therein. Thereafter, the metal cup is placed into a recess of the vanity case and adhered thereto. In another conventional method, a cosmetic material mixed with a binder and dissolved in a solvent is poured into a metal cup of the same type as set forth above or directly into a recessed space in the vanity case and then dried by vaporizing the solvent to solidify the cosmetic material.

However, in the former method, a part of the powder cosmetic material is dispersed by overflowing from the metal cup when the pressure is applied thereto. Therefore, not only the environmental area of the filling operation is stained, but also a great amount of the cosmetic material is lost. In addition, there was a possibility that the metal cup is so deformed by the pressure that it cannot be placed into the recess of the vanity case.

On the other hand, in the latter method, some problems have been experienced after evaporation of the solvent, such as a concaved deformation on the surface of the solidified cosmetic material, crack formation on the solidified cosmetic material, and contraction of the solidified cosmetic material which may cause it to loosen and come out of the metal cup or from the recessed space formed in the vanity case.

Accordingly, an object of the present invention is to provide an improved method which can load a cosmetic material into a hollow space without the conventional drawbacks set forth above.

Another object of the present invention is to provide an improved method which can quickly load a cosmetic material into a hollow space by a quick evaporation of solvent mixed in the cosmetic material.

A further object of the present invention is to provide improved method which can form a powder cosmetic material into a rod-shape and then contain it into a cylindrical casing.

SUMMARY OF THE INVENTION

According to the present invention, a method is provided for loading a cosmetic material into a hollow space, which comprises the steps of preparing a cosmetic material having fluidity by mixing powder cosmetic material with a binder and solvent, injecting the cosmetic material under a predetermined pressure into the hollow space closed by a porous absorbing material, the pressure being maintained for a time period after the closed space is filled with the cosmetic material, whereby the solvent in the cosmetic material is absorbed into the absorbing material and the powder cosmetic material is solidified in the closed space.

Preferably, after separating the solidified cosmetic material from the porous absorbing material, hot air is applied to the absorbing material to evaporate the solvent therein and expel the solvent therefrom. Instead of the hot air, vacuum may be applied to the absorbing material to draw the solvent therein to the outside thereof.

More preferably, when the cosmetic material is injected into the hollow space, a vacuum is applied to the porous absorbing material from outside of the hollow space.

An apparatus for carrying out the method of the present invention includes a porous absorbent block arranged to define at least a part of a closed hollow space, means for injecting the cosmetic material into the closed hollow space, the cosmetic material being prepared by mixing powder cosmetic material with a binder and solvent, means for separating the absorbent block from the cosmetic material solidified in the hollow space, and means for removing the absorbed solvent from the block after separating the block from the solidified cosmetic material.

Further objects and features of the present invention will become apparent from the following detailed description of preferred embodiments thereof when taken in conjunction with the accompanying drawings, in which:

DETAILED DESCRIPTION OF THE INVENTION

Figure 1:
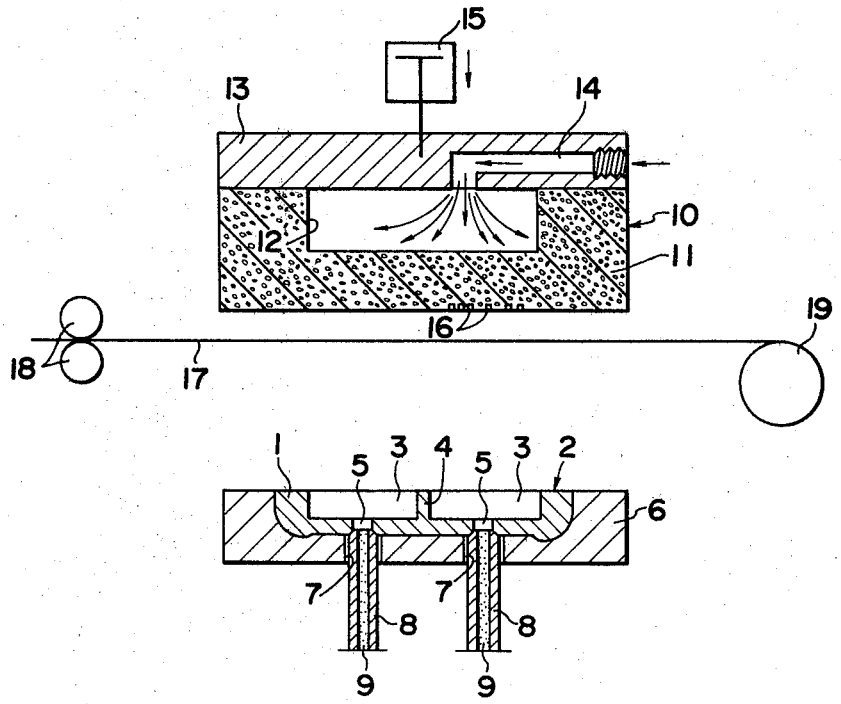
FIG. 1 is a schematic sectional front view showing a first embodiment of an apparatus which is employable in the present invention and which is shown in an inoperative position.
Figure 2:
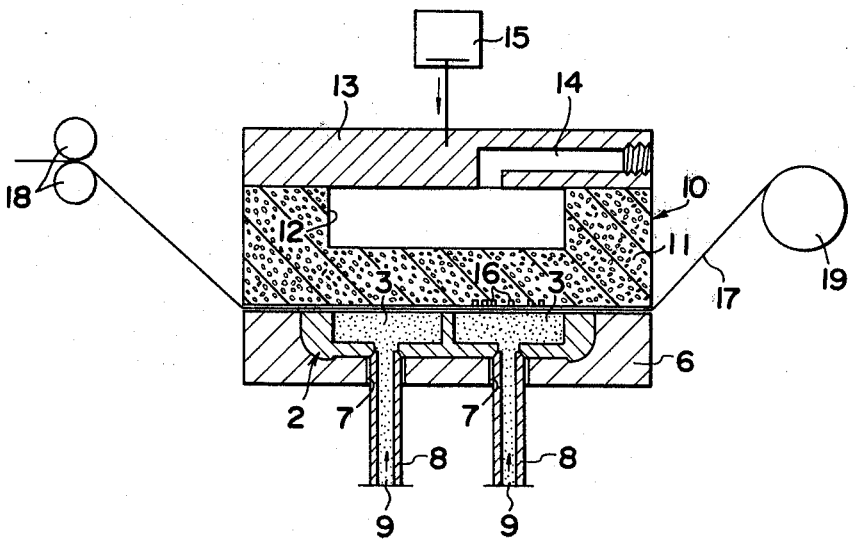
FIG. 2 is a schematic sectional front view of the same apparatus as shown in FIG. 1 but in an operative position.

In a first embodiment of the method of the present invention shown in FIGS. 1 and 2, an apparatus is shown for loading and molding cosmetic materials directly into a casing structure, i.e. in this embodiment a receptacle 1 of a vanity case 2. The receptacle 1 is separated into two recessed sections 3—3 by a central partition wall 4 thereof. Each recessed section 3 has a hole 5 through the bottom thereof, through which cosmetic material of different color can be injected into the recessed section as discussed hereinafter in detail. The receptacle 1 of the vanity case 2 is held in position by a supporting block 6. That is, the receptacle 1 is snugly received in a concave of the supporting block. This supporting block 6 has holes 7—7 through the bottom thereof in communication with the holes 5—5 of the receptacle 1. Inserted into the holes 7—7 of the supporting block 6 are a pair of nozzles 8—8 the upper ends of which are directly fitted to the holes 5—5 of the receptacle 1. These nozzles 8—8 are connected with a pressurized fluid supply means (not shown) such as a piston device driven by air cylinders, so that powder cosmetic materials 9 mixed with a binder and solvent are supplied by a predetermined constant pressure which is maintained continuously during filling process.

Provided above the supporting block 6 is a device 10 for absorbing the solvent in the cosmetic material. The device 10 comprises an absorbent block 11 of porous material such as a block of blotting paper or a sintered block of high molecular powder material. The absorbent block 11 has a concave air space 12 at the upper center part thereof which is defined by vertical peripheral walls thereof, upon which a holder plate 13 is fixed and closes the concave air space 12. The holder plate 13 has an angled passage 14 therethrough by which the concave air space 12 in the absorbent block 11 is connected with an outside heater and fan (not shown). It is arranged that hot air be supplied into the concave air space from the heater and fan through the angled passage 14 when it is desired to dry the solvent in the absorbent block 11. The holder plate 13 is connected to an air cylinder 15 in such a manner that the holder plate 13 as well as the absorbent block can be moved up and down. Preferably, the lower surface of the absorbent block 11 has an embossed pattern section 16, the function of which shall be described hereinafter in detail.

Provided between the absorbent block 11 and the supporting block 6 is a sheet net 17, which is stretched between a pair of rollers 18 and a winder 19 and arranged to be transferred intermittently.

Referring now to a method according to a first embodiment of the present invention, the receptacle 1 of the vanity case 2 is first placed in the concave of the supporting block 6 while the latter is separated from the sheet net 17 and from the absorbent block 11, as shown in FIG. 1. Then, by the action of the air cylinder 15, the holder plate 13 as well as the absorbent block 11 connected thereto is moved down until the absorbent block 11 is pressed upon the supporting block 6 with the sheet net 17 interposed therebetween, as shown in FIG. 2. Thus, the hollow spaces 3—3 in the receptacle 1 are completely covered by the sheet net 17 and the absorbent block 11. Thus, block 11 and receptacle 1 form a mold structure having therein mold cavities partially defined by block 11 and partially defined by receptacle 1. Then, cosmetic material which is normally prepared by mixing powder cosmetic material with a binder such as a surface active agent, oil or fat and 25 to 65wt% of solvent such as ethyl alcohol, isopropyl alcohol or isoparaffin is injected into the closed hollow spaces 3—3 or mold cavities in the receptacle 1 through the bottom holes 5—5 thereof by the nozzles 8—8 inserted into the holes 7—7 of the supporting block 6 and fitted under pressure to the bottom holes 5—5 of the receptacle. Preferably, differently colored cosmetic materials are injected into the respective hollow spaces 3—3 through the two nozzles 8—8. The injection pressure is, preferably, in the range of 4 to 6 kg/cm$^2$. A higher pressure will cause an undesirable leakage of the injected cosmetic material from the interface between the receptacle 1, the sheet net 17 and the adsorbent block 11.

By such injection of the cosmetic material, the solvent therein is absorbed into the porous absorbent block 11 by capillary action. At this time, since the injection pressure is maintained in the range of 4 to 6 Kg/cm$^2$, the capillary action in the absorbent block 11 is facilitated. Also, although the solvent in the cosmetic material is mostly absorbed in the absorbent block 11, no reduction of volume of the cosmetic material is caused in the receptacle due to the continuous filling of the cosmetic material from the nozzles 8—8. It could be noted in experiments that 60 to 70 wt% of solvent in the cosmetic material is absorbed into the absorbent block 11 within five to ten seconds and that the injected cosmetic material in the receptacle is almost completely solidified or solidly bound within the above-mentioned time.

A small amount of solvent (about 7.5 to 14wt%) not absorbed in the absorbent block but remaining in the injected cosmetic material is vaporized into the atmosphere by the natural process of aging. Thus, no drying process is necessary in the present invention as required in the conventional method.

After a predetermined period of time has passed during which the injected cosmetic material is solidified in the receptacle 1, the holder plate 13 as well as the adsorbent block 11 are raised by the action of the air cylinder 15 to a level above the horizontally stretched sheet net 17, as shown in FIG. 1. Then, hot air is supplied under pressure into the concave air space 12 of the absorbent block through the angled passage 14 from the outside heater and fan (not shown). The hot air blown into the concave air space 12 then passes through the porous absorbent block 11 and is discharged outside thereof. At this time, the solvent which has been absorbed in the absorbent block 11 is expelled outside thereof along with the hot air and immediately vaporized, so that the absorbent block 11 is dried completely. Thereafter, the sheet net 17 is wound by the winder for a predetermined length so as to position an unused part of the sheet net 17 between the absorbent block 11 and the supporting block 6.

Figure 3:
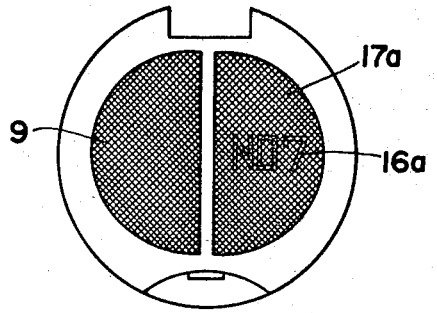
FIG. 3 is a plan view of a vanity cast filled with cosmetic materials in accordance with the first embodiment of the present invention.

The cosmetic material 9 filled in the recessed sections 3—3 of the receptacle 1 is shown in FIG. 3, in which the net pattern 17*a* thereon is provided to indicate the unused state of the cosmetic material and an embossed pattern thereon is provided for decorative purposes. Accordingly, it is possible in the present invention without any problem to eliminate or omit the sheet net 17 as well as the embossed pattern section 16 on the absorbent block 11.

Figure 4:
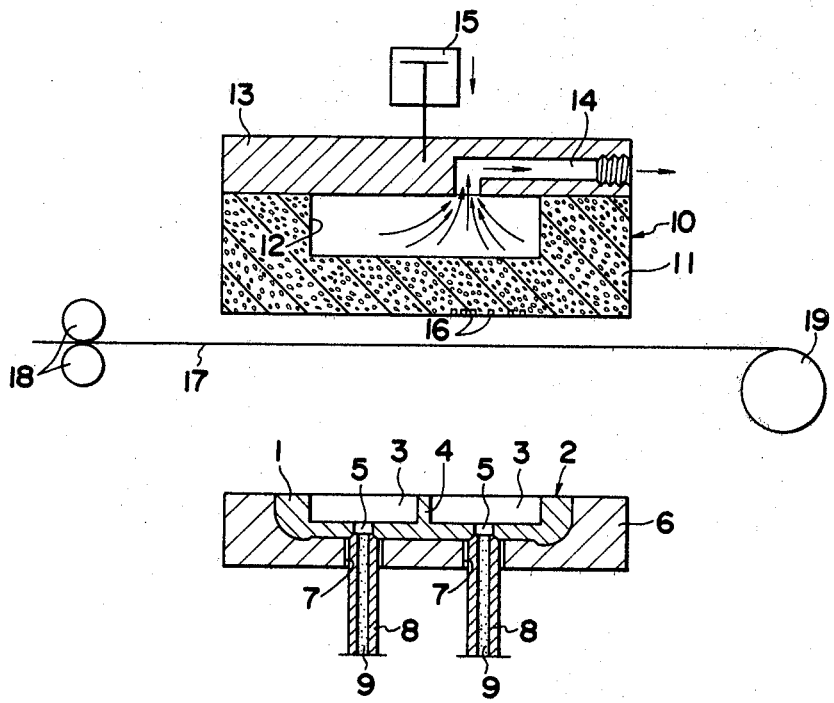
FIG. 4 is a schematic sectional front view of a second embodiment of an apparatus which is employable in the present invention and which is shown in an inoperative position.

In the first embodiment of the present invention set forth above, the hot air is supplied to vaporize the solvent absorbed in the absorbent block. However, according to a second embodiment of the present invention shown in FIG. 4, in which the same reference numerals have been employed for the same elements as in the first embodiment, vacuum is applied to the concave air space of the absorbent block 11 instead of hot air. That is, the angled passage 14 in the holder plate 13 is connected with an outside vacuum source (not shown). In operation, in order to dry the absorbent block 11, the vacuum is applied in the concave air space 12 therein through the vacuum source. Therefore, the solvent in the absorbent block 11 is sucked to the inside of the concave air space 12 as shown by arrows in FIG. 4 and released outside as vapor. Other structures and operations of the second embodiment are substantially the same as those described in the first embodiment and, therefore, detailed descriptions thereof are omitted herein.

Figure 5:
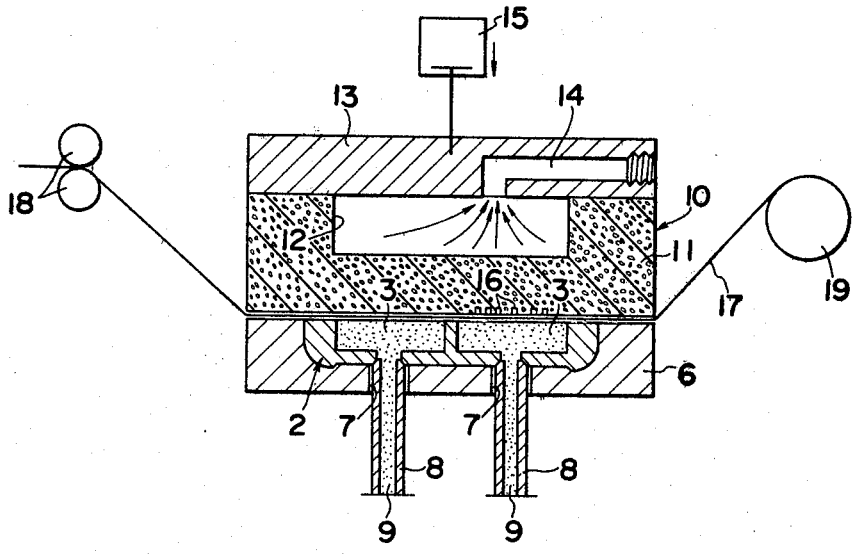
FIG. 5 is a schematic sectional front view of a third embodiment of an apparatus which is employable in the present invention and which is shown in an operative position.

Reference is now made to a third embodiment of the present invention shown in FIG. 5, in which the same reference numerals have been employed for the same elements as in the first embodiment. In this embodiment, the angled passage 14 in the holder plate 13 is connected with an outside vacuum source (not shown) so as to apply vacuum in the concave air space of the absorbent block, as in the case of the second embodiment. However, the vacuum in the third embodiment is applied during the time when the absorbent block 11 is pressed against the supporting block 6 with the sheet net 17 interposed therebetween, as shown by arrows in FIG. 5. By such application of vacuum, the absorption of the solvent into the absorbent block 11 is considerably facilitated and the solidification of the cosmetic material in the recessed sections 3—3 of the receptacle 1 occurs very rapidly. As to the evaporation of the solvent absorbed in the absorbent block 11, such is possible after separating the absorbent block 11 upwardly from the supporting block to apply hot air under pressure into the concave air space 12 of the adsorbent block 11 as described in the first embodiment or, alternatively, to apply vacuum again as described above in the second embodiment. Other structures and operations of the third embodiment are substantially the same as those described in the first embodiment and, therefore, detailed descriptions thereof are omitted herein.

Figure 6:
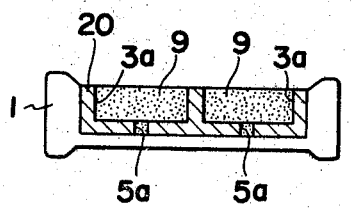
FIG. 6 is a sectional view of a vanity case in which a metal casing filled with cosmetic materials is embedded therein.

In the first through third embodiments set forth above, the receptacle 1 of the vanity case 2 is directly filled with cosmetic materials 9 through the bottom holes 5—5 thereof. However, in place of the receptacle 1 of the vanity case, a shallow metal cup having the same recessed sections 3*a*—3*a* and bottom holes 5*a*—5*a* as those 3—3 and 5—5 in the receptacle can be placed in the supporting block 6. Then, the metal cup is filled with the cosmetic materials in the same way as set forth in the embodiments described above and, thereafter, the metal cup shown in FIG. 6 by reference numeral 20 is snugly fitted in a recess of the receptacle 1 of the vanity case 2.

In another modification of the above embodiments, holes may be made through side walls of the receptacle or metal cup in place of the bottom holes 5—5 and 5*a*—5*a* for injecting the cosmetic materials into the closed hollow spaces.

In the above embodiments, the cosmetic materials are loaded into sectionally U-shaped hollow spaces having open upper ends. However, the present invention cannot be limited to such shape of the spaces and can be applied to form the powder cosmetic material into a rod shape. A fourth embodiment of the invention in FIGS. 7 to 11 shows a method and apparatus for forming the powder cosmetic material into a rod shape by injecting it into a cylindrical hollow space.

Figure 9:
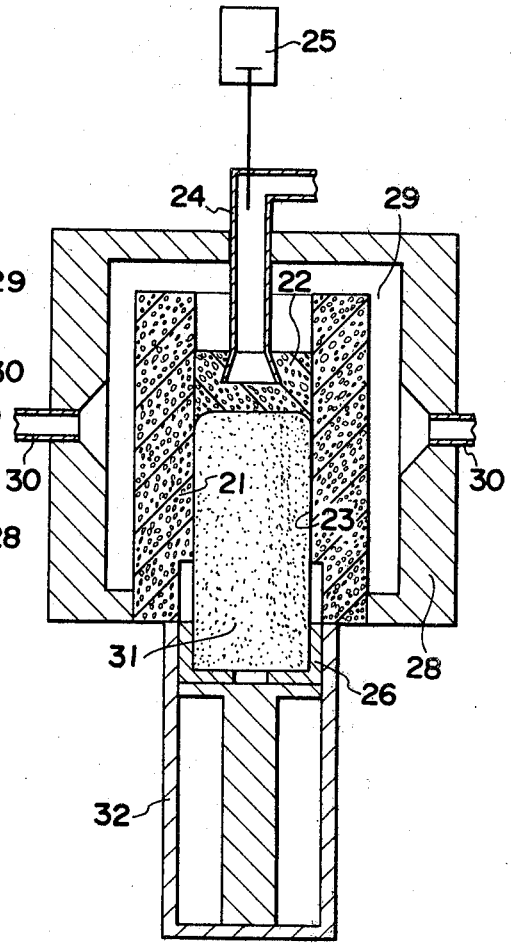
Figure 10:
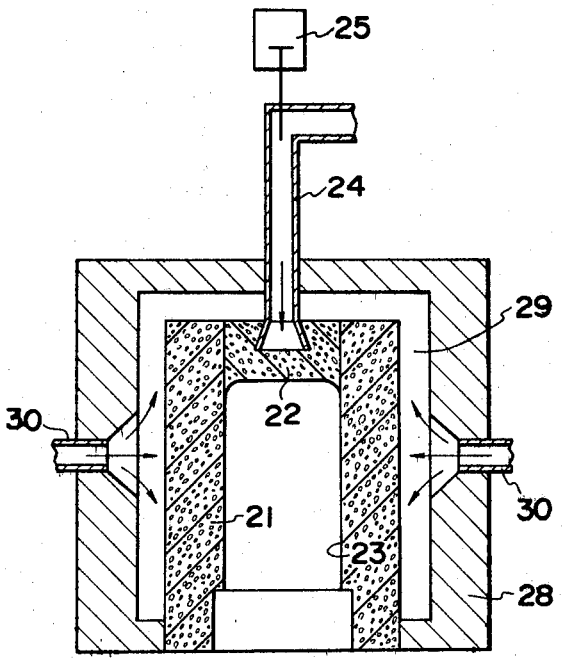
Figure 11:
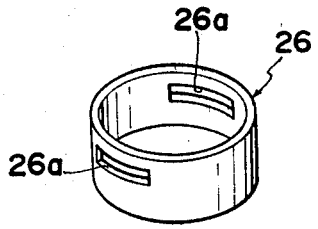
FIG. 11 is a perspective view showing a ring-shaped holder to be used in the present invention.
Figure 12:
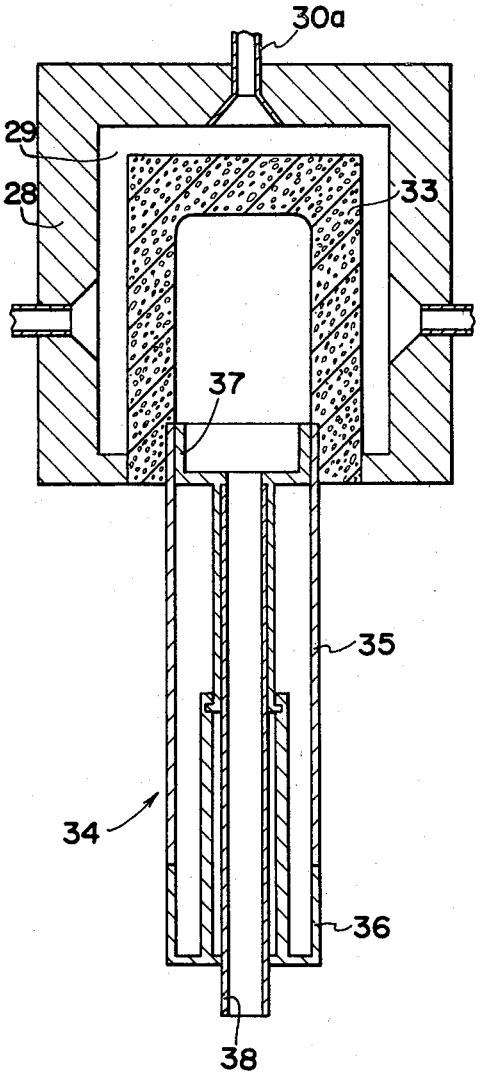
FIG. 12 through FIG. 15 are schematic sectional views showing a fifth embodiment of an apparatus and sequential operation thereof according to the present invention.

Referring to FIGS. 7 to 11, an apparatus employable in a forth embodiment of the invention comprises a hollow cylindrical adsorbent block 21 which is closed at the upper end portion thereof by an adsorbent disc 22. The adsorbent block 21 as well as the disc 22 are made of the same porous material as set forth above in the first embodiment. The adsorbent disc 22 has an outer diameter substantially equal to the inner diameter of the hollow cylindrical adsorbent block 21 and is slidably disposed in the axial hollow space 23 of the block 21. The adsorbent disc 22 is connected to the lowr end of an air nozzle 24 which in turn is connected to a piston of an air cylinder 25, so that by the operation of the air cylinder 25, the adsorbent disc 22 is moved up and down along the axial hollow space 23. Preferably, the lower end of the air nozzle 24 is embedded in the absorbent disc. The lower inner end of the cylindrical adsorbent block 21 is annularly cut away to provide an annular recess into which a casing structure in the form of a shallow cup-shaped holder 26 is snugly fitted. This holder 26 is provided with a hole at the bottom thereof into which the upper end of an injection nozzle 27 is snugly fitted. Preferably, the cup-shaped holder 26 has a plurality of window holes 26*a*—26*a* through the peripheral wall thereof as shown in FIG. 11.

Provided around the adsorbent block 21 and disc 22 is an inverted cup-shaped frame 28. This frame 28 is spaced from the block 21 and disc 22 except the lower end thereof so that a closed air space 29 is defined therebetween. The frame 28 has a pair of air holes 30—30 through the opposite side walls thereof. These air holes 30—30 as well as the air nozzle 24 are selectively connected to a vacuum means and hot air supply means (not shown) through change valves (not shown).

Figure 7:
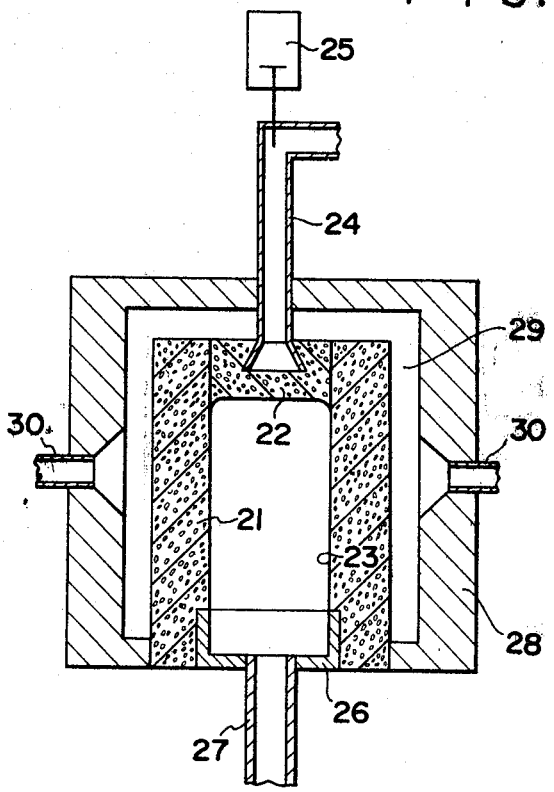
FIG. 7 through FIG. 10 are schematic sectional views showing a fourth embodiment of an apparatus and sequential operation thereof according to the present invention.
Figure 8:
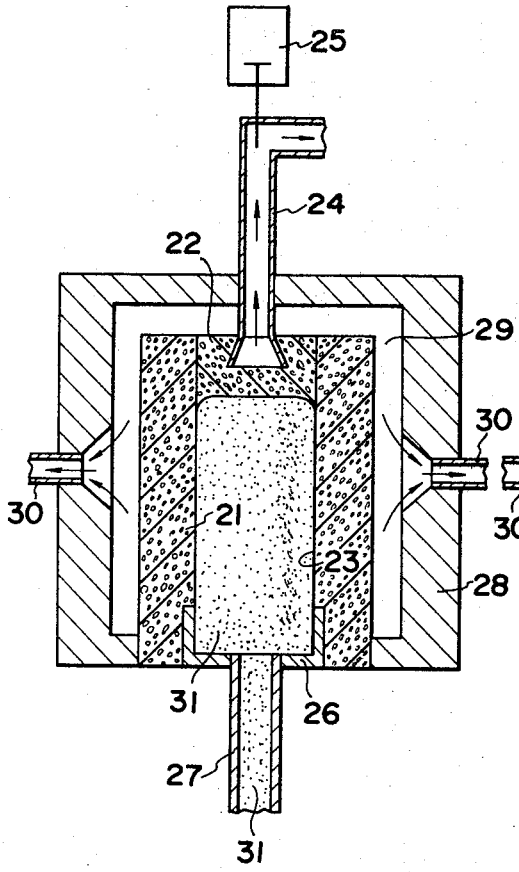

In operation, the shallow cup-shaped holder 26 is first fitted into the annular recess at the lower end of the cylindrical absorbent block 21. Then, the upper end of the injection nozzle 27 is also fitted into the bottom hole of the cup-shaped holder 26, as shown in FIG. 7. Thus, block 21, disc 22 and holder 26 form a mold structure having therein a mold cavity partially defined by porous members 21 and 22 and partially defined by holder 26. Thereafter, a powder cosmetic material 31 mixed with a binder and solvent is injected from the nozzle 27 into the hollow space or mold cavity 23 enclosed by the absorbent block 21 and disc 22. The injection pressure in the nozzle 27 is maintained for a time period, even after the hollow space 23 is filled with the cosmetic material. At the same time as injection of the cosmetic material 31, vacuum is applied to the closed space 29 through the air holes 30—30 and also to the absorbent disc 22 through the air nozzle 24, as shown by arrows in FIG. 8. Thus, the vacuum suction is applied to the injected cosmetic material 31 through the pores of the absorbent block 21 and disc 22 and, therefore, the solvent in the cosmetic material 31 is drawn into the absorbent block 21 and disc 22 and partially discharged outside through the air nozzle 24 and air holes 30—30. Accordingly, the solidification of the cosmetic material is facililated very much by the application of the vacuum.

After the cosmetic material is solidified or solidly bound, the application of vacuum is stopped and the injection nozzle 27 is removed from the cup-shaped holder 26. Then, a cylindrical casing 32 of the conventional type such as used for a lipstick and which has an inner case which can be advanced and retracted is fitted directly below the cup-shaped holder 26. Thereafter, the air cylinder 25 is operated to extend the piston rod downwardly, whereby the absorbent disc 22 connected to the air nozzle 24 is moved down and, therefore, pushes the solidified rod-shaped cosmetic material downwardly until the cup-shaped holder 26 is inserted into the cylindrical casing 32, as shown in FIG. 9. Thus, the formed and solidified cosmetic material is contained in the casing 32 without being exposed to the external enviroment.

After the rod-shaped cosmetic material is contained in the casing 32, the air cylinder 25 is operated to move the absorbent disc 22 to the original upper position. Then, hot air is supplied from the air nozzle 24 and air holes 30—30 into the absorbent block 21 and disc 22 to evaporate the solvent therein and expel it from the lower opening of the cylindrical absorbent block 21, as shown in FIG. 10.

In the above embodiment, the cosmetic material 31 is formed into a rod shape on the shallow cup-shaped holder 26 and then is snugly pressed into the cylindrical casing 32 by lowering the absorbent disc 22. However, in a fifth embodiment shown in FIGS. 12 to 15, it becomes unnecessary to lower the absorbent disc 22 as in the case of the fourth embodiment by using a special cylindrical casing 34. A hollow absorbent block 33 in the fifth embodiment is integrally formed into an inverted deep cup shape. Instead of the air nozzle 24 and air cylinder 25 in the fourth embodiment, an air hole 30*a* is provided through the top wall of the frame 28 in the fifth embodiment.

The cylindrical casing 34 in the fifth embodiment comprises a hollow outer case 35 the upper end of which is fitted to a lower annular recess of the absorbent block 33, a lower end cap 36 rotatably connected to the outer case 35, and a casing structure in the form of an inner holder cup 37 connected to the end cap 36 so as to be slidable up and down along the inner wall of the outer case 35 by the rotation of the end cap 36 in opposite directions. The end cap 36 and the holder cup 37 each have a vertical hollow space at the center part thereof in which an injection nozzle 38 is snugly inserted. Thus, porous block 33 and cup 37 form a mold structure having therein a mold cavity partially defined by porous block 33 and partially defined by cup 37.

Figure 13:
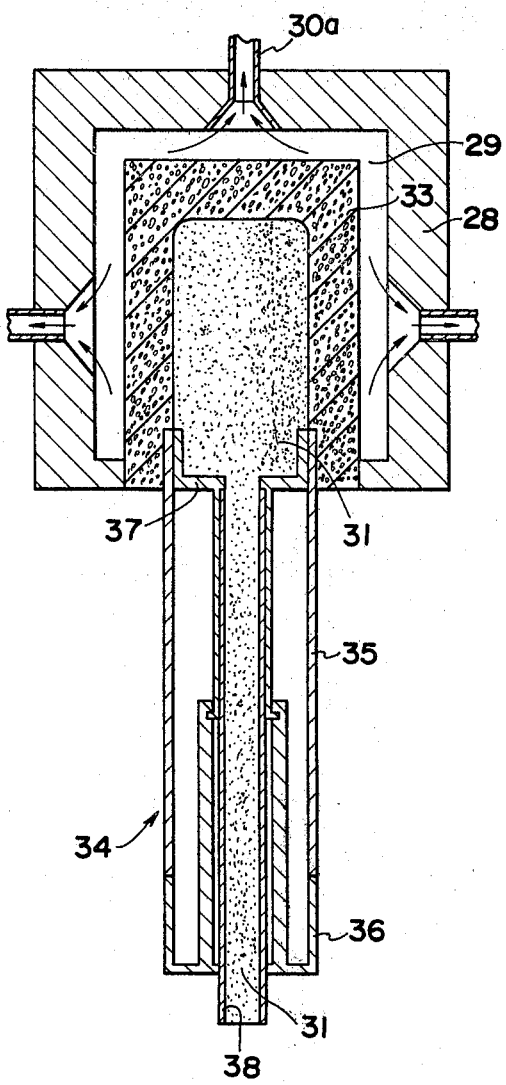
Figure 14:
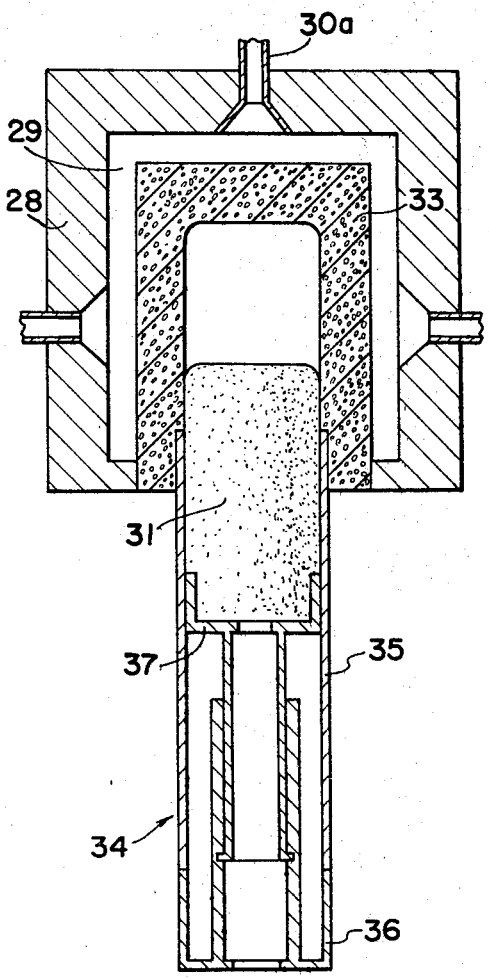
Figure 15:
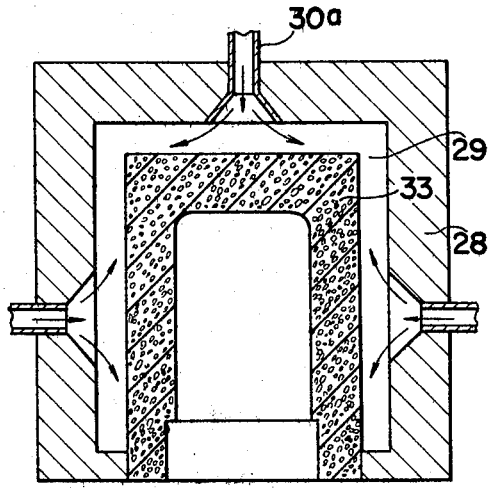

In operation, while the inner holder cup 37 is raised to the uppermost position, a cosmetic material 31 is injected into the closed hollow space or mold cavity of the absorbent block 33 through the injection nozzle, as shown in FIG. 13. At this time, vacuum is applied to the closed air space between the absorbent block 33 and the frame 28 through the air holes 30—30 and 30*a*. Thus, as in the case of the fourth embodiment, the solvent in the cosmetic material is absorbed and, therefore, the injected cosmetic material is solidified quickly. As the cosmetic material is molded into a rod-shape and solidified or solidly bound on the inner holder cup 37, after removing the injection nozzle 38, the solidified cosmetic material can be contained into the cylindrical casing 34 by the rotation of the end cap 36, as shown in FIG. 14. After completely containing the rod-shaped cosmetic material in the casing 34 and removing it from below the absorbent block, hot air is supplied into the closed air space 29 between the absorbent block 33 and the frame 28 to evaporate the solvent in the block 21 and expel it to outside from the lower opening thereof, as shown in FIG. 15. Other structures and operations of the fifth embodiment are substantially the same as those described in the fourth embodiment and, therefore, detailed explanations thereof are omitted herein.

As will be understood from the description of the preferred embodiments of the present invention, it becomes possible in the present invention to load cosmetic materials very quickly into a desired casing. Since the loading of the cosmetic material can be accomplished without the cosmetic material being exposed to the external environment, the cosmetic material is sanitary. Also, the simple structure of the present apparatus makes it possible to automatically load the cosmetic material into a vanity case such as a compact case, cylindrical case or the like.

Although the present invention has been described with reference to preferred embodiments thereof, many modifications and alterations may be made within the spirit of the present invention. For example, the powder cosmetic material in the present invention includes such as used for making pressed powder, mascara, eye-liner, eye shadow, cheek rouge, lipstick.

What is claimed is:

1. A method of molding a cosmetic material, said method comprising:

(a) preparing a fluent mixture of cosmetic material by mixing powder cosmetic material with a binder and a solvent;

(b) providing a mold structure having therein a mold cavity partially defined by a porous absorbing material and partially defined by a casing structure;

(c) injecting said mixture of cosmetic material under a predetermined pressure into said mold cavity and filling said mold cavity;

(d) maintaining said pressure for a time period after said mold cavity is filled with said mixture of cosmetic material;

(e) absorbing said solvent from said mixture of cosmetic material into said porous absorbing material and thereby causing a bonding of said powder cosmetic material in a solid molded shape; and (f) separating said porous absorbing material from said molded cosmetic material and from said casing structure, thereby retaining said molded cosmetic material in said structure.

2. A method as claimed in claim 1, further comprising, after said step (f), applying hot air to said porous absorbing material to evaporate the solvent therein and expel said solvent therefrom.

3. A method as claimed in claim 1, further comprising, after said step (f), applying a vacuum to said porous absorbing material to draw the solvent therefrom and expel said solvent to the exterior thereof.

4. A method as claimed in claim 1, 2 or 3, further comprising, during said step (c), applying a vacuum to said porous absorbing material from the exterior thereof, thereby to facilitate the absorbing of said solvent from said cosmetic material into said porous absorbing material.

5. A method as claimed in claim 1, 2 or 3, wherein said mold cavity is partially defined by a shallow cup-shaped casing and said mixture of cosmetic material is injected into said mold cavity through a hole in the bottom of said shallow cup-shaped casing, and said casing is closed at an upper end thereof by a plate of said porous absorbing material.

6. A method as claimed in claim 5, wherein said casing is a metal cup adapted to be fitted to a concave in a vanity case.

7. A method as claimed in claim 5, wherein said casing is a recessed section of a vanity case.

8. A method as claimed in claim 5, further comprising sandwiching a sheet net between said plate of said porous material and the upper end of said casing before injection of said cosmetic material.

9. A method as claimed in claim 1, 2 or 3, wherein said mold cavity is a vertically elongated space defined by said porous absorbing material and formed above a shallow cup-shaped casing, and said cosmetic material is injected into said mold cavity from a hole made through the bottom of said casing.

10. A method as claimed in claim 9, wherein a top part of said porous absorbing material is made to be movable into said elongated space and moved down after said cosmetic material is bound in said mold cavity to forcedly lower said molded cosmetic material as well as said hollow cup-shaped casing from said mold cavity.

11. A method as claimed in claim 9, wherein a cylindrical casing having said shallow cup-shaped casing therein is provided below said elongated space with said cup-shaped casing being fitted to the lower end of said porous absorbing material, said cylindrical casing as well as said cup-shaped casing have holes through the bottoms thereof through which said cosmetic material is injected into said mold cavity, and said cup-shaped casing is moved downwardly into said cylindrical casing after bonding of said cosmetic material.

* * * * *